US011040853B2

(12) United States Patent
Fauconnet et al.

(10) Patent No.: US 11,040,853 B2
(45) Date of Patent: Jun. 22, 2021

(54) ELEVATOR SYSTEM HOISTWAY ACCESS CONTROL

(71) Applicants: Otis Elevator Company, Farmington, CT (US); Aurélien Fauconnet, Isdes (FR)

(72) Inventors: Aurélien Fauconnet, Isdes (FR); Pascal Rebillard, Gien (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 720 days.

(21) Appl. No.: 15/572,417

(22) PCT Filed: May 7, 2015

(86) PCT No.: PCT/IB2015/000848

§ 371 (c)(1),
(2) Date: Nov. 7, 2017

(87) PCT Pub. No.: WO2016/178050

PCT Pub. Date: Nov. 10, 2016

(65) Prior Publication Data

US 2018/0134518 A1 May 17, 2018

(51) Int. Cl.

| | |
|---|---|
| ***B66B 13/16*** | (2006.01) |
| ***B66B 5/00*** | (2006.01) |
| ***B66B 5/28*** | (2006.01) |

(52) U.S. Cl.
CPC ..... *B66B 5/0056* (2013.01); *B66B 5/005* (2013.01); *B66B 5/288* (2013.01)

(58) Field of Classification Search
CPC ..... B66B 5/0056; B66B 5/005; B66B 5/288
(Continued)

(56) References Cited

U.S. PATENT DOCUMENTS 5,727,657 A * 3/1998 Foelix ..... B66B 5/005 187/356
6,138,798 A * 10/2000 Macuga ..... B66B 5/005 187/294

(Continued)

FOREIGN PATENT DOCUMENTS

CN 1240605 C 2/2006
CN 103964267 A 8/2014

(Continued)

OTHER PUBLICATIONS

Chinese Office Action Issued in CN Application No. 201580079708.3, dated Feb. 2, 2019, 9 Pages.

*Primary Examiner* — Christopher Uhlir
(74) *Attorney, Agent, or Firm* — Cantor Colburn LLP

(57) ABSTRACT

A hoistway access system for an elevator includes an access switch positioned at a selected landing floor 34 of an elevator and operably connected to a controller 46. A remote controlled lock 48 is located at landing doors of a landing floor providing access to a hoistway pit 36, and is operably connected to the controller. A safety actuation system is operably connected to an elevator car and operably connected to the controller. The controller is configured to command a drive system to drive the elevator car to an upper location when the access switch is activated, to define a selected safety volume in the hoistway defined by the hoistway pit and the elevator car, command engagement of the safety actuation system to stop and hold the elevator car, and command the lock to unlock when the safety actuation system is engaged, thereby allowing access to the hoistway via the landing doors.

17 Claims, 5 Drawing Sheets

(58) Field of Classification Search
USPC ..... 187/247
See application file for complete search history.

(56) References Cited

U.S. PATENT DOCUMENTS

| | | | | |
|---|---|---|---|---|
| 6,202,797 | B1 | 3/2001 | Skolnick et al. | |
| 6,223,861 | B1 * | 5/2001 | Sansevero | B66B 13/22 187/316 |
| 6,847,292 | B2 * | 1/2005 | Nlabu | B66B 5/027 187/390 |
| 7,140,470 | B2 | 11/2006 | Azpitarte | |
| 7,350,627 | B2 | 4/2008 | Ketonen et al. | |
| 7,650,971 | B2 | 1/2010 | Pillin et al. | |
| 8,960,372 | B2 | 2/2015 | Heath et al. | |
| 2003/0117292 | A1 * | 6/2003 | Nlabu | B66B 5/027 340/5.2 |
| 2004/0173415 | A1 * | 9/2004 | Kocher | B66B 13/245 187/316 |
| 2011/0253483 | A1 * | 10/2011 | Rebillard | B66B 1/467 187/247 |
| 2012/0305334 | A1 | 12/2012 | Kocher et al. | |
| 2014/0076667 | A1 | 3/2014 | Henseler | |
| 2014/0216856 | A1 | 8/2014 | Hovi et al. | |
| 2017/0320704 | A1 * | 11/2017 | Studer | B66B 5/0087 |
| 2017/0355570 | A1 * | 12/2017 | Witczak | B66B 13/30 |
| 2018/0134518 | A1 * | 5/2018 | Fauconnet | B66B 5/288 |
| 2018/0229973 | A1 * | 8/2018 | Beauchaud | B66B 13/28 |
| 2019/0322485 | A1 * | 10/2019 | Kattainen | B66B 5/02 |
| 2019/0389694 | A1 * | 12/2019 | Herkel | B66B 5/005 |
| 2019/0389695 | A1 * | 12/2019 | Monzon | B66B 5/16 |

FOREIGN PATENT DOCUMENTS

| | | | |
|---|---|---|---|
| EP | 1110900 | A1 | 6/2001 |
| EP | 1281654 | A1 | 2/2003 |
| EP | 1246770 | B1 | 7/2003 |
| EP | 1471028 | A1 | 10/2004 |
| EP | 1444161 | B1 | 2/2006 |
| EP | 2099705 | A1 | 9/2006 |
| EP | 1773704 | A1 | 4/2007 |
| EP | 1882666 | A1 | 1/2008 |
| EP | 2033927 | A1 | 3/2009 |
| EP | 2197776 | A1 | 6/2010 |
| EP | 2229335 | A1 | 9/2010 |
| EP | 2623452 | A1 | 8/2013 |
| EP | 2765108 | A1 | 8/2014 |
| GB | 1498039 | | 1/1978 |
| JP | 2007276896 | A | 10/2007 |
| JP | 2010024015 | A | 2/2010 |
| WO | 2005105644 | A1 | 11/2005 |
| WO | 2008081073 | A1 | 7/2008 |
| WO | 2009050328 | A1 | 4/2009 |
| WO | 2014106682 | A1 | 7/2014 |

* cited by examiner

ELEVATOR SYSTEM HOISTWAY ACCESS CONTROL

CROSS REFERENCE TO RELATED APPLICATION

This application is a National Stage application of PCT/IB2015/000848, filed May 7, 2015, the entire contents of which are hereby incorporated by reference.

BACKGROUND

The subject matter disclosed herein relates to elevator systems. More particularly, the present disclosure relates to hoistway access control for technicians and/or maintenance personnel.

In current, typical elevator systems, when elevator car doors are opened at a landing floor, there is a clearance or gap between the landing door and the car door of, in some systems, about 30 mm. Because of this clearance, dust or passenger goods (e.g.: keys or other items) can fall in the hoistway and land in the pit at the bottom of the hoistway. Consequently, the pit has to be frequently cleaned. To clean the pit or to retrieve passenger goods that fall into the pit, mechanics or the house keepers have to open the lowest landing door and access the pit with a pit ladder, climbing down the pit ladder to clean the pit and/or retrieve the items.

In order to protect the mechanics or technicians, etc., during those operations, codes and/or regulations have specified a safety volume and clearance for technicians entering the hoistway resulting in a larger overall volume of the elevator systems, while elevator system customers desire that the elevator system occupy a smaller overall volume. Thus, new elevator systems are being developed in which many maintenance activities can be performed from inside the car, alleviating the need to provide such a safety volume in the pit. A way for accessing the pit to clean the pit and/or retrieve customer items still must be provided, however as the clearance of 30 mm will be still needed.

BRIEF SUMMARY

In one embodiment, a hoistway access system for an elevator system includes an access switch positioned at a selected landing floor of a hoistway of an elevator system and operably connected to a controller. A remote controlled lock is located at landing doors of a landing floor providing access to a hoistway pit, the lock operably connected to the controller. A safety actuation system is operably connected to an elevator car located in the hoistway and operably connected to the controller. The controller is configured to command a drive system to drive the elevator car to an upper location of the hoistway when the access switch is activated, the upper location sufficient to define a selected safety volume in the hoistway defined by the hoistway pit and the elevator car. The controller is configured to command engagement of the safety actuation system to stop and hold the elevator car in the hoistway via a car guide rail, and command the remote controlled lock to unlock when the safety actuation system is engaged, thereby allowing access to the hoistway via the landing doors providing access to the hoistway pit.

Additionally or alternatively, in this or other embodiments the access switch is activated by one of a key, a key pad or a magnetic card.

Additionally or alternatively, in this or other embodiments the upper location of the hoistway is an uppermost landing floor of the elevator system.

Additionally or alternatively, in this or other embodiments the safety actuation system is one of mechanically or electrically operated.

In another embodiment, a method for accessing a hoistway of an elevator system includes activating an access switch located at a landing floor of the elevator system and driving an elevator car located in the hoistway to a selected upper location of the hoistway via activation of the access switch to define a selected safety volume in the hoistway defined by a hoistway pit and the elevator car. A safety actuation system located at the elevator car is engaged to stop and hold the elevator car at the selected upper location in the hoistway. A landing door providing access to the pit is opened at the landing floor when the elevator car safeties are engaged via the safety actuation system, thereby allowing access to the hoistway via the landing doors.

Additionally or alternatively, in this or other embodiments a remote controlled lock is disengaged at the landing floor doors automatically when the elevator car safeties are engaged, thereby allowing opening of the landing floor doors.

Additionally or alternatively, in this or other embodiments the hoistway is entered to clean the hoistway pit and/or retrieve items from the hoistway pit.

Additionally or alternatively, in this or other embodiments the landing floor doors are closed after accessing the hoistway and deactivating the access switch.

Additionally or alternatively, in this or other embodiments deactivating the access switch returns the elevator system to a normal operational mode.

Additionally or alternatively, in this or other embodiments the landing floor is a landing floor providing access to the hoistway pit of the elevator system.

Additionally or alternatively, in this or other embodiments the selected upper location is an uppermost landing floor of the elevator system.

Additionally or alternatively, in this or other embodiments the safety actuation system is one of electrically or mechanically operated.

In yet another embodiment, an elevator system includes a hoistway, an elevator car located in and drivable along the hoistway, and a hoistway access system. The hoistway access system includes an access switch positioned at a selected landing floor of the hoistway and operably connected to a controller, a remote controlled lock located at landing doors of the selected landing floor and operably connected to the controller, and a safety system located at the elevator car and operably connected to the controller. The controller is configured to command a drive system to drive the elevator car to a selected upper location of the hoistway when the access switch is activated, command engagement of the safety system to stop and hold the elevator car a guide rail at the selected upper location, and command the remote controlled lock to unlock when the safety system is engaged, thereby allowing access to the hoistway via the landing doors.

Additionally or alternatively, in this or other embodiments the access switch is activated by a one of a key, key pad or magnetic card.

Additionally or alternatively, in this or other embodiments the selected upper location of the hoistway is an uppermost landing floor of the elevator system.

Additionally or alternatively, in this or other embodiments the selected landing floor provides access to a hoistway pit of the elevator system.

Additionally or alternatively, in this or other embodiments the safety system is one of electrically or mechanically operated.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
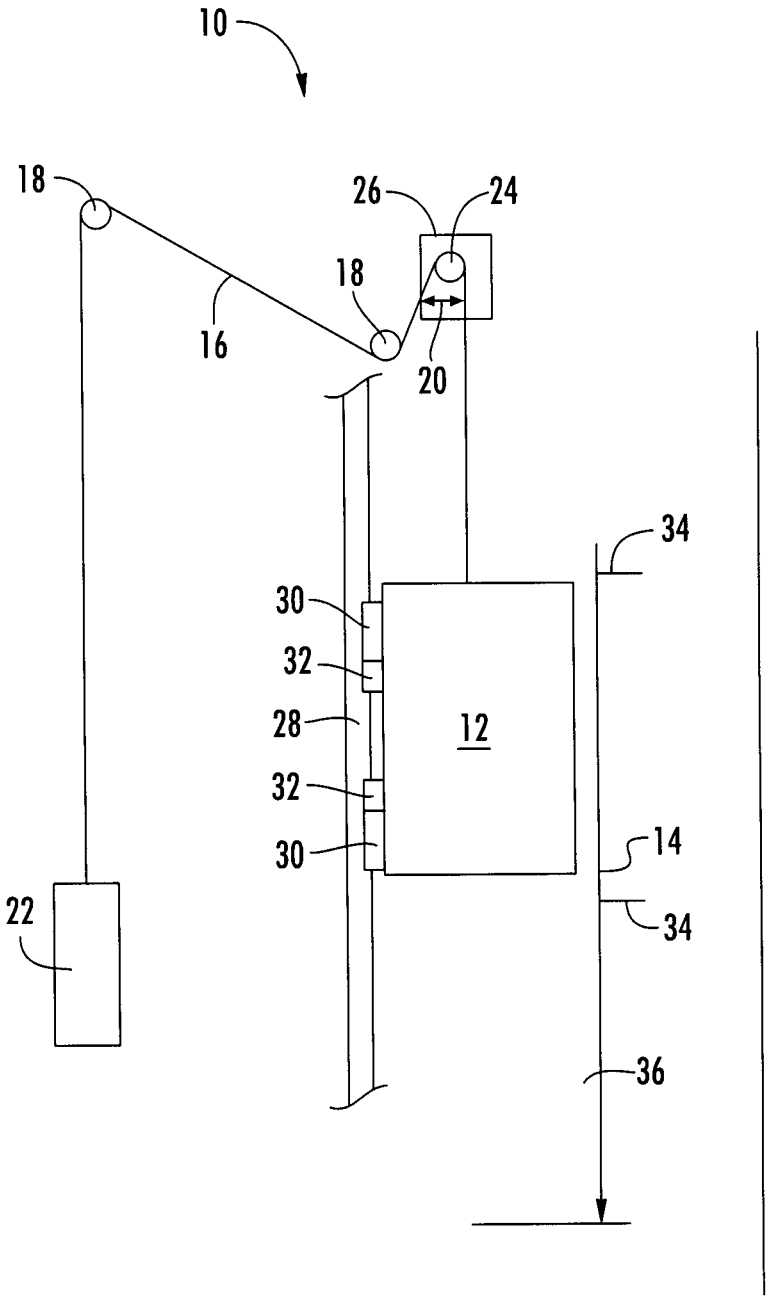
FIG. 1 is a schematic view of an embodiment of an elevator system.

Shown in FIG. 1 is a schematic of an exemplary traction elevator system 10. The elevator system 10 includes an elevator car 12 operatively suspended or supported in a hoistway 14 with one or more suspension members 16, such as ropes or belts. The one or more suspension members 16 interact with one or more sheaves 18 to be routed around various components of the elevator system 10. The one or more sheaves 18 could also be connected to a counterweight 22, which is used to help balance the elevator system 10 and reduce the difference in suspension member 16 tension on both sides of a traction sheave 24 during operation.

The sheaves 18 each have a diameter 20, which may be the same or different than the diameters of the other sheaves 18 in the elevator system 10. At least one of the sheaves could be a traction sheave 24. The traction sheave 24 is driven by a machine 26. Movement of traction sheave 24 by the machine 26 drives, moves and/or propels (through traction) the one or more suspension members 16 that are routed around the traction sheave 24. At least one of the sheaves 18 could be a diverter, deflector or idler sheave. Diverter, deflector or idler sheaves are not driven by the machine 26, but help guide the one or more suspension members 16 around the various components of the elevator system 10. While the embodiments are described in relation to elevator systems with suspension members, one skilled in the art will readily appreciate that the present disclosure may be applied to other types of elevator systems, such as those with self-propelled elevator cars lacking suspension members.

The elevator system 10 further includes one or more guide rails 28 to guide the elevator car 12 along the hoistway 14. The elevator car includes one or more guide shoes or rollers 30 interactive with the guide rails 28 to guide the elevator car 12, and also may include safeties 32 interactive with the guide rail 28 to slow and/or stop motion of the elevator car 12 under certain conditions, such as an overspeed condition.

The hoistway 14 includes one or more landing floors 34 at which the elevator car 12 stops to allow ingress and/or egress of passengers from the elevator car 12 through elevator car doors (not shown). The hoistway 14 further includes a pit 36, defined as the portion of the hoistway 14 below the elevator car 12 when the elevator car 12 is positioned at the lowest landing floor 34 of the hoistway 14.

Figure 2:
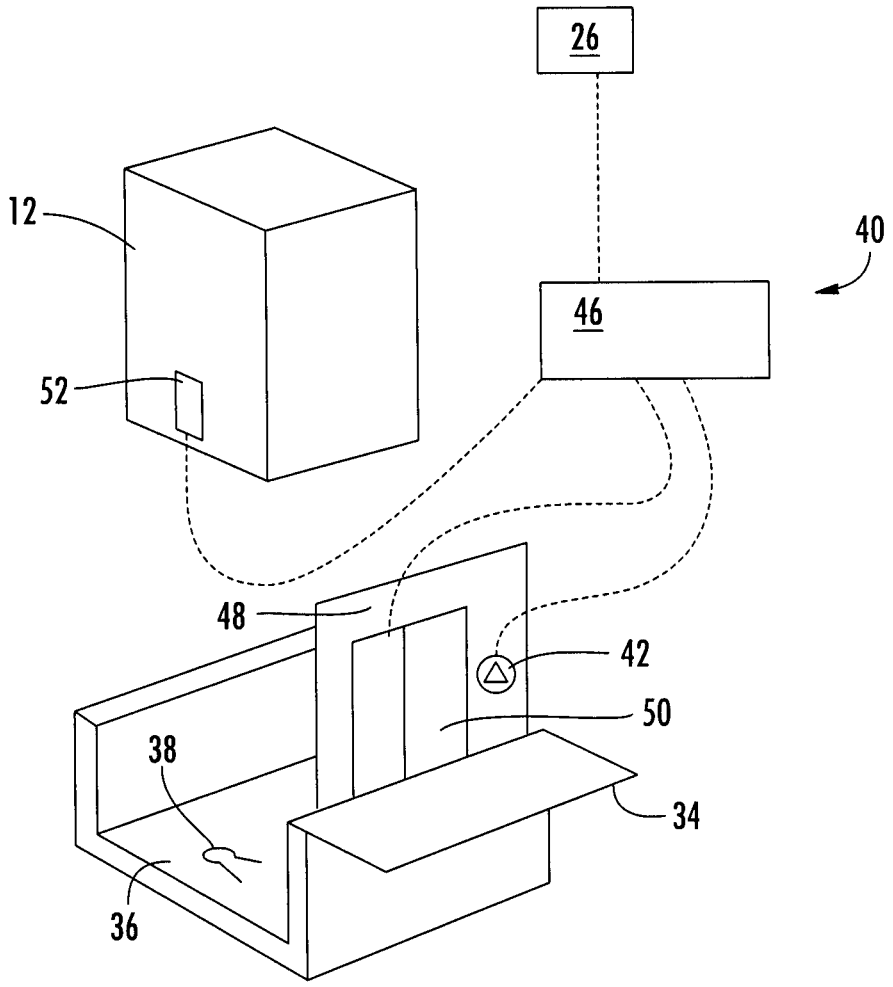
FIG. 2 is a schematic of an embodiment of a hoistway access system for an elevator system.

Referring to FIG. 2, the pit 36 is periodically accessed by technicians or other personnel to clean the pit 36 or to retrieve items, such as keys 38 that may inadvertently fall into the pit 36. To allow for safe access to the pit 36, the elevator system 10 includes a hoistway entry system 40. The hoistway entry system 40 includes an access switch 42, which in some embodiments is located at a lowest landing floor 34 of the elevator system 10. In other embodiments, the access switch 42 may be located elsewhere, such as a control cabinet of the elevator system 10, which may be located at any landing floor. The access switch 42 is activated by the technician when it is desired to enter the pit 36. In some embodiments, the access switch 42 is activated via a triangular key or other means such as a key pad, magnetic card, or the like. The access switch 42 is operably connected to an elevator system controller 46, which controls operation of the machine 26. The elevator system controller 46 is also connected to a remote controlled lock 48 at a landing door providing access to the pit 50 and further connected to an electrical or mechanical safety actuation module 52 positioned at the elevator car 12.

Figure 3A:
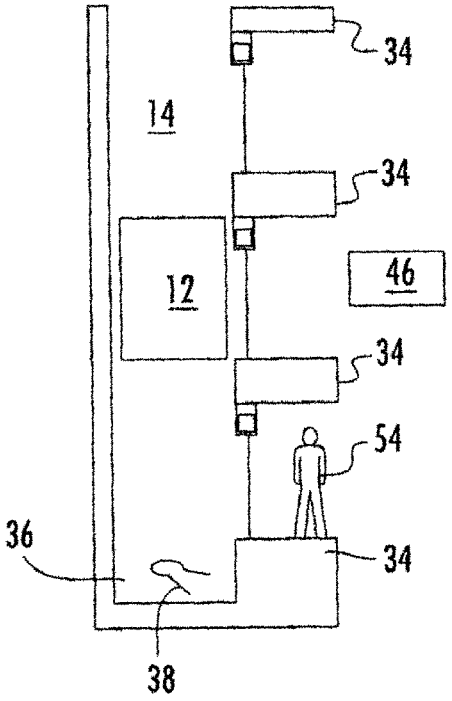
FIGS. 3*a*-3*f* illustrate steps in operation of an embodiment of a hoistway access system of an elevator system.
Figure 3B:
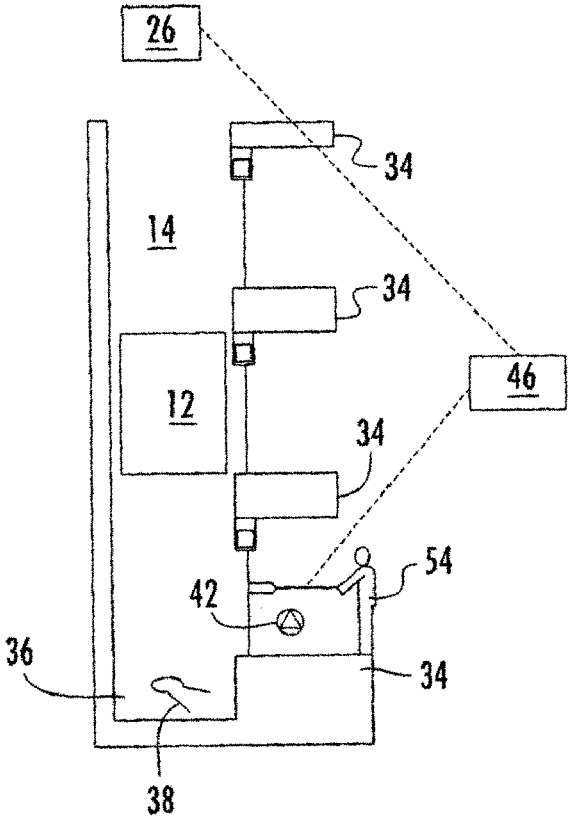
Figure 3C:
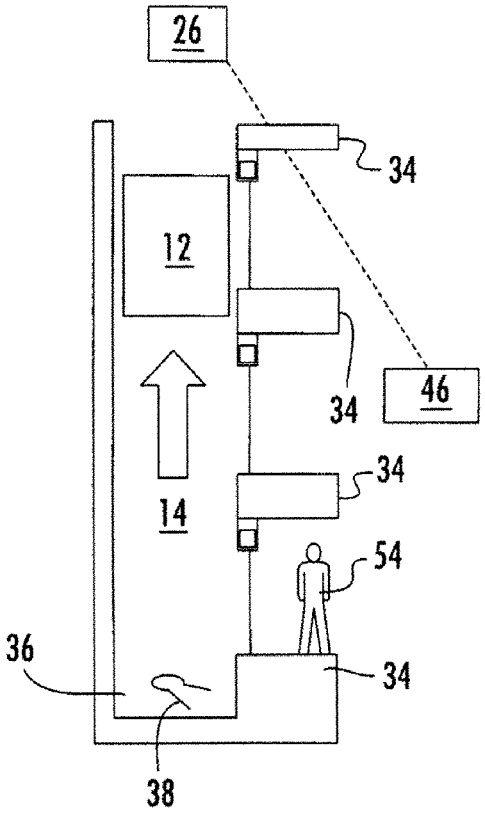
Figure 3D:
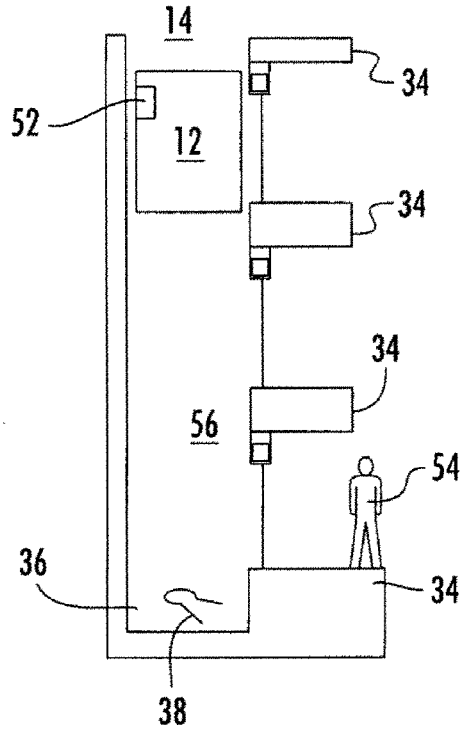

Operation of the hoistway entry system 40 will now be described with reference to FIGS. 3*a*-3*f*. In FIG. 3*a*, a technician 54 desires to enter the pit 36, and proceeds to the landing floor 34 of the elevator system 10 where the access switch 42 is located. In FIG. 3*b*, the technician 54, initiates the hoistway entry system 40 by activating the access switch 42. Referring to FIG. 3*c*, when the access switch 42 is activated, the elevator system controller 46 commands the machine 26 to drive the elevator car 12 to an uppermost landing floor 34 of the hoistway 14, or alternatively to another landing floor 34 that provides a selected volume of space for the technician 54 to access and work in the pit 36. Next, referring to FIG. 3*d*, the hoistway entry system 40 activates the safety actuation module 52, which could be either mechanical or electrical, at the elevator car 12. The system controller commands the machine 26 to drive the elevator car 12 slowly downwardly in the hoistway 14, causing the safeties 32 to activate, stopping and holding the elevator car 12 in the hoistway 14 via the car guide rails 28, to create a safety volume 56 defined by the pit 36 and the elevator car 12 in the hoistway 12. Alternatively, the elevator car 12 may be driven to any location in the hoistway 14, such as between landing floors 34, provided a resulting safety volume 56 below the elevator car 12 is achieved.

Figure 3E:
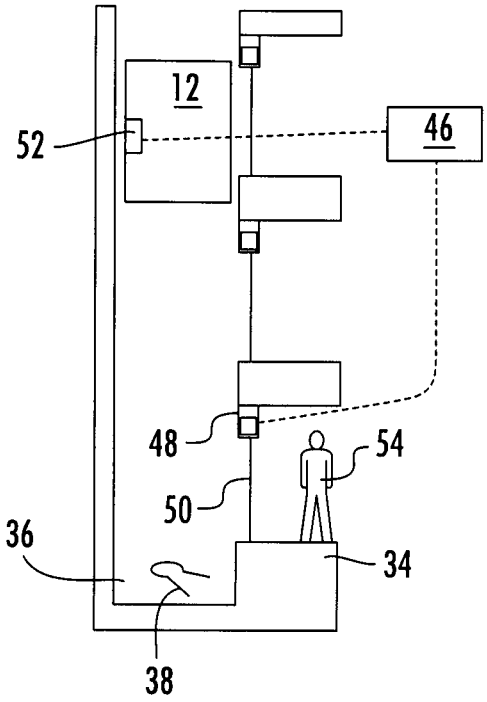
Figure 3F:
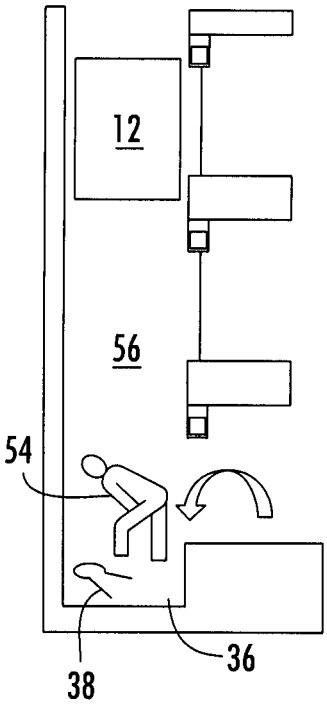

Referring now to FIG. 3*e*, the elevator system controller 46 detects that the safeties 32 are engaged, the remote control lock 48 releases the landing door providing access to the pit 50, and in FIG. 3*f* the technician 54 can then open the landing door 50 and enter the pit 36 for cleaning of the pit 36 and/or retrieving of items in the pit 36. When the technician 54 completes operations in the pit 36, the technician 54 exits the pit 36, returning to the landing floor 34. The technician 54 then deactivates the hoistway access system 40 via operation of the access switch 42, returning the elevator system 10 to normal operation.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A hoistway access system for an elevator system comprising:

an access switch disposed at a selected landing floor of a hoistway of an elevator system and operably connected to a controller;

a remote controlled lock disposed at landing doors of a landing floor providing access to a hoistway pit, the lock operably connected to the controller; and a safety actuation system operably connected to an elevator car located in the hoistway and operably connected to the controller;

wherein the controller is configured to:

command a drive system to drive the elevator car to an upper location of the hoistway in response to activation of the access switch, the upper location sufficient to define a selected safety volume in the hoistway defined by the hoistway pit and the elevator car;

command engagement of the safety actuation system to stop and hold the elevator car in the hoistway via a car guide rail; and command the remote controlled lock to unlock when the safety actuation system is engaged, thereby allowing access to the hoistway via the landing doors providing access to the hoistway pit.

2. The hoistway access system of claim 1, wherein the access switch is activated by one of a key, a key pad or a magnetic card.

3. The hoistway access system of claim 1, wherein the upper location of the hoistway is an uppermost landing floor of the elevator system.

4. The hoistway access system of claim 1, wherein the safety actuation system is one of mechanically or electrically operated.

5. A method for accessing a hoistway of an elevator system comprising:

activating an access switch located at a landing floor of the elevator system;

driving an elevator car disposed in the hoistway to a selected upper location of the hoistway in response to activation of the access switch to define a selected safety volume in the hoistway defined by a hoistway pit and the elevator car;

engaging a safety actuation system disposed at the elevator car to stop and hold the elevator car at the selected upper location in the hoistway; and opening a landing door providing access to the pit at the landing floor when an elevator car safety is engaged via the safety actuation system, thereby allowing access to the hoistway via the landing door.

6. The method of claim 5, further comprising disengaging a remote controlled lock at the landing door automatically when the elevator car safety is engaged, thereby allowing opening of the landing door.

7. The method of claim 5, further comprising entering the hoistway to clean the hoistway pit and/or retrieve items from the hoistway pit.

8. The method of claim 5, further comprising closing the landing door after accessing the hoistway and deactivating the access switch.

9. The method of claim 8, wherein deactivating the access switch returns the elevator system to operation.

10. The method of claim 5, wherein the landing floor is a landing floor providing access to the hoistway pit of the elevator system.

11. The method of claim 5, wherein the selected upper location is an uppermost landing floor of the elevator system.

12. The method of claim 5, wherein the safety actuation system is one of electrically or mechanically operated.

13. An elevator system comprising:

a hoistway;

an elevator car disposed in and drivable along the hoistway; and a hoistway access system including:

an access switch disposed at a selected landing floor of the hoistway and operably connected to a controller;

a remote controlled lock disposed at landing doors of the selected landing floor and operably connected to the controller; and a safety system located at the elevator car and operably connected to the controller;

wherein the controller is configured to:

command a drive system to drive the elevator car to a selected upper location of the hoistway in response to activation of the access switch;

command engagement of the safety system to stop and hold the elevator car in the hoistway via a guide rail at the selected upper location; and command the remote controlled lock to unlock when the safety system is engaged, thereby allowing access to the hoistway via the landing doors.

14. The elevator system of claim 13, wherein the access switch is activated by a one of a key, key pad or magnetic card.

15. The elevator system of claim 13, wherein the selected upper location of the hoistway is an uppermost landing floor of the elevator system.

16. The elevator system of claim 13, wherein the selected landing floor provides access to a hoistway pit of the elevator system.

17. The elevator system of claim 13, wherein the safety system is one of electrically or mechanically operated.

* * * * *